US012729685B2

(12) United States Patent
Tang et al.

(10) Patent No.: US 12,729,685 B2
(45) Date of Patent: Sep. 8, 2026

(54) COMPRESSOR AND AIR CONDITIONER

(71) Applicant: Gree Electric Appliances, Inc. of Zhuhai, Zhuhai (CN)

(72) Inventors: Han Tang, Zhuhai (CN); Zhiping Zhang, Zhuhai (CN); Xiaokun Wu, Zhuhai (CN)

(73) Assignee: Gree Electric Appliances, Inc. of Zhuhai, Zhuhai (CN)

( * ) Notice: Subject to any disclaimer, the term of this patent is extended or adjusted under 35 U.S.C. 154(b) by 0 days.

(21) Appl. No.: 18/713,531

(22) PCT Filed: Aug. 30, 2022

(86) PCT No.: PCT/CN2022/115850
§ 371 (c)(1),
(2) Date: May 24, 2024

(87) PCT Pub. No.: WO2023/093179
PCT Pub. Date: Jun. 1, 2023

(65) Prior Publication Data

US 2025/0020125 A1 Jan. 16, 2025

(30) Foreign Application Priority Data

Nov. 26, 2021 (CN) ..... 202111422397.X

(51) Int. Cl.
*F04C 18/16* (2006.01)

(52) U.S. Cl.
CPC ..... *F04C 18/16* (2013.01); *F04C 2240/801* (2013.01); *F04C 2270/165* (2013.01); *F04C 2270/175* (2013.01)

(58) Field of Classification Search
CPC ..... F04C 18/16; F04C 2240/801; F04C 2270/16; F04C 2270/165; F04C 2270/17; F04C 2270/175
See application file for complete search history.

(56) References Cited

U.S. PATENT DOCUMENTS 3,467,300 A 9/1969 Schibbye
6,257,839 B1 * 7/2001 Fang ..... F04C 28/06 417/283

(Continued)

FOREIGN PATENT DOCUMENTS

CN 209033764 U 6/2019
CN 110821830 A * 2/2020 ..... F04C 29/12

(Continued)

OTHER PUBLICATIONS

PCT/CN2022/115850, International Search Report, Nov. 29, 2022.
PCT/CN2022/115850, Written Opinion of the International Searching Authority, Nov. 29, 2022.

*Primary Examiner* — Thomas Fink
(74) *Attorney, Agent, or Firm* — The Webb Law Firm

(57) ABSTRACT

The compressor has: a housing; a first rotor disposed spaced apart from the housing, the first rotor being capable of rotating along a first axis. The first rotor including a first portion and a second portion with opposite thread rotating direction; a first spacer, at least a portion of the first spacer being disposed between the first portion and the housing; and a first driving assembly in driving connection with the first spacer to control the first spacer to move along a direction of the first axis.

13 Claims, 4 Drawing Sheets

(56) References Cited

U.S. PATENT DOCUMENTS

| | | | | |
|---|---|---|---|---|
| 2007/0196228 | A1* | 8/2007 | Tunna | F04C 29/0092 418/201.1 |
| 2013/0101390 | A1* | 4/2013 | Nachtergaele | F04C 29/0021 415/1 |
| 2020/0003214 | A1 | 1/2020 | Johnson et al. | |

FOREIGN PATENT DOCUMENTS

| | | | | | |
|---|---|---|---|---|---|
| CN | 111043033 | A | * | 4/2020 | F04C 29/12 |
| CN | 112796999 | A | | 5/2021 | |
| CN | 112833011 | A | * | 5/2021 | F04C 18/16 |
| CN | 113389727 | A | | 9/2021 | |
| CN | 113389730 | A | | 9/2021 | |
| CN | 114017324 | A | | 2/2022 | |
| CN | 216306221 | U | | 4/2022 | |
| DE | 2844940 | C2 | * | 1/1990 | F04C 29/0021 |
| JP | 2007510856 | A | | 4/2007 | |
| WO | WO-9637706 | A1 | * | 11/1996 | F04C 18/16 |
| WO | WO-2021253058 | A1 | * | 12/2021 | F04C 29/021 |

* cited by examiner

COMPRESSOR AND AIR CONDITIONER

CROSS-REFERENCE TO RELATED APPLICATIONS

The application is the United States national phase of International Application No. PCT/CN2022/115850 filed Aug. 30, 2022, and claims priority to Chinese Patent Application No. 202111422397.X, filed on Nov. 26, 2021, the disclosures of which are hereby incorporated by reference in their entirety.

FIELD OF THE INVENTION

The present disclosure relates to the technical field of compressors, and specifically relates to a compressor and an air conditioner.

DESCRIPTION OF RELATED ART

Screw compressors are widely applied to air power, refrigeration air conditioners and various process flows because of their characteristics of compactness, high efficiency, reliable performance, strong adaptability and the like. The market share of screw compressors continues to increase. A screw compressor is provided with a pair of screw rotors meshing with each other and having opposite thread rotating direction, each screw rotor is correspondingly provided with a suction end and a discharge end, and suction, compression and discharge are realized through rotational movement of the pair of screw rotors in a machine body.

In practical application, during operation of the screw compressor, the screw rotors operate for a long time, and interference is easily generated between the two screw rotors and between the rotors and the housing, which causes collision or abrasion of the rotors and the housing, thus reducing the reliability of the compressor and affecting the stability of the entire rotor system and the compressor.

BRIEF SUMMARY OF THE INVENTION

Embodiments of the present disclosure provide a compressor, including:

a housing;

a first rotor disposed spaced apart from the housing, the first rotor being capable of rotating along a first axis, the first rotor including a first portion and a second portion with opposite thread rotating direction;

a first spacer, at least a portion of the first spacer being disposed between the first portion and the housing; and a first driving assembly in driving connection with the first spacer to control the first spacer to move along a direction of a first axis.

In some embodiments, the compressor further includes a first shaft, the first portion is sleeved on the first shaft, and the second portion is integrally formed with the first shaft.

In some embodiments, a side of the housing facing the first portion is provided with a first accommodating chamber, the first driving assembly is disposed within the first accommodating chamber, a portion of the first spacer is located within the first accommodating chamber, and another portion of the first spacer is located between the first portion and the housing.

In some embodiments, the first driving assembly includes a motor and a transmission assembly, the transmission assembly is in driving connection with the first spacer, and the transmission assembly drives the first spacer to move along the direction of the first axis under the driving of the motor.

In some embodiments, the compressor further includes a first distance sensor for detecting a distance between the first spacer and an end of the first portion.

In some embodiments, the first driving assembly is configured to control the first spacer to move along the direction of the first axis according to a distance between the first spacer and an end of the first portion.

In some embodiments, when controlling the first spacer to move along the direction of the first axis according to the distance between the first spacer and an end of the first portion, the first driving assembly is configured such that: when the distance between the first spacer and an end of the first portion is greater than a predetermined distance threshold, the first driving assembly controls the first spacer to move along the direction of the first axis towards a first portion of the first rotor; when the distance between the first spacer and the end of the first portion is less than or equal to the predetermined distance threshold, the first driving assembly controls the first spacer to move along the direction of the first axis towards the housing.

In some embodiments, the compressor further includes:

a second rotor disposed spaced apart from the housing, the second rotor being configured to rotate along a second axis, the second rotor including a third portion and a fourth portion with opposite thread rotating direction, the third portion being configured to at least partially fit and mesh with the first portion, the fourth portion being configured to at least partially fit and mesh with the second portion; and a second shaft, the third portion and the fourth portion being sleeved on the second shaft.

In some embodiments, the compressor further includes: a second spacer, at least a portion of the second spacer being disposed between the fourth portion and the housing; and a second driving assembly in driving connection with the second spacer to control the second spacer to move along a direction of the second axis.

In some embodiments, a side of the housing facing the fourth portion is provided with a second accommodating chamber, the second driving assembly is disposed within the second accommodating chamber, a portion of the second spacer is located within the second accommodating chamber, and another portion of the second spacer is located between the fourth portion and the housing.

In some embodiments, the compressor further includes a second distance sensor for detecting a distance between the second spacer and an end of the fourth portion.

In some embodiments, the second driving assembly is configured to control the second spacer to move along the direction of the second axis according to a distance between the second spacer and an end of the fourth portion.

In some embodiments, when controlling the second spacer to move along the direction of the second axis according to the distance between the second spacer and an end of the fourth portion, the second driving assembly is configured to: control the second spacer to move along the direction of the first axis towards the fourth portion of the second rotor when the distance between the second spacer and an end of the fourth portion is greater than a predetermined distance threshold;

control the second spacer to move along the direction of the second axis towards the housing when the distance between the second spacer and an end of the fourth portion is less than or equal to the predetermined distance threshold.

Some embodiments of the present disclosure also provide an air conditioner including the compressor of any one of the foregoing.

By providing the first spacer between the first rotor and the housing, connecting the first driving assembly with the first spacer, and controlling the first spacer to move along the direction of the first axis, the compressor provided by some embodiments of the present disclosure makes it always to maintain a predetermined gap between the first rotor and the housing, so that collision or abrasion of the first rotor and the housing are avoided, thus improving the stability of the rotor system and the compressor.

BRIEF DESCRIPTION OF THE DRAWINGS

In order to more clearly explain the technical solutions in the embodiments of the present disclosure, the accompanying drawings to be used in the description of the embodiments will be briefly introduced below. It is obvious that the accompanying drawings described below are merely some of the embodiments of the present disclosure. For those skilled in the art, they may also obtain other drawings based on these drawings without involving any inventive effort.

For a more complete understanding of the present disclosure and its advantageous effects, a description will be given below in combination with the accompanying drawings, wherein the same reference signs represent the same parts in the following description.

10. first shaft; 11. first axis; 12. first end; 13. second end;

20. first rotor; 21. first portion; 22. second portion; 201. first suction end face; 202. first discharge end face; 203. second suction end face; 204. second discharge end face;

30. second shaft; 31. second axis; 32. third end; 33. fourth end;

40. second rotor; 41. third portion; 42. fourth portion; 401. third suction end face; 402. third discharge end face; 403. fourth suction end face; 404. fourth discharge end face;

50. housing; 51. first accommodating chamber; 52. second accommodating chamber;

60. electric motor;

71. first spacer; 72. second spacer;

81. first driving assembly; 82. second driving assembly;

91. first distance sensor; 92. second distance sensor;

100: compressor.

DETAILED DESCRIPTION OF THE INVENTION

Hereinafter, a clear and complete description of the technical solutions in the embodiments of the present disclosure will be made in combination with the accompanying drawings in the embodiments of the present disclosure. Obviously, the embodiments described are only a part of rather than all of the embodiments of the present disclosure. All the other embodiments obtained by those skilled in the art based on the embodiments in the present disclosure without involving any inventive effort shall fall within the protection scope of the present disclosure.

Embodiments of the present disclosure provide a compressor, such as a screw compressor and a scroll compressor, which is applied to a fluid machine such as an air conditioner.

Figure 1:
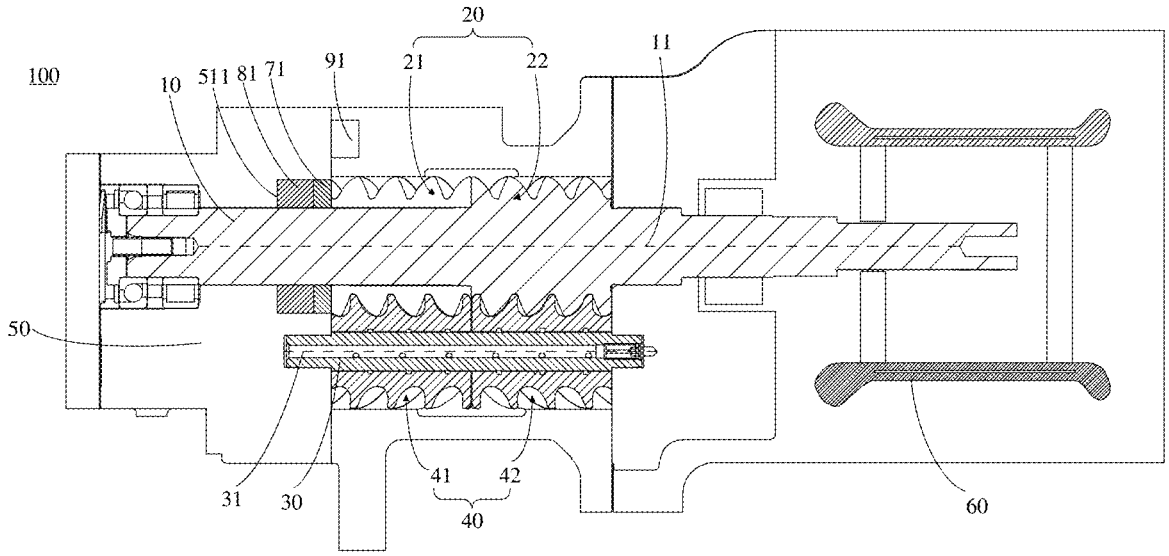
FIG. 1 is a schematic view of part of the structure of a compressor of a first type provided by some embodiments of the present disclosure.
Figure 2:
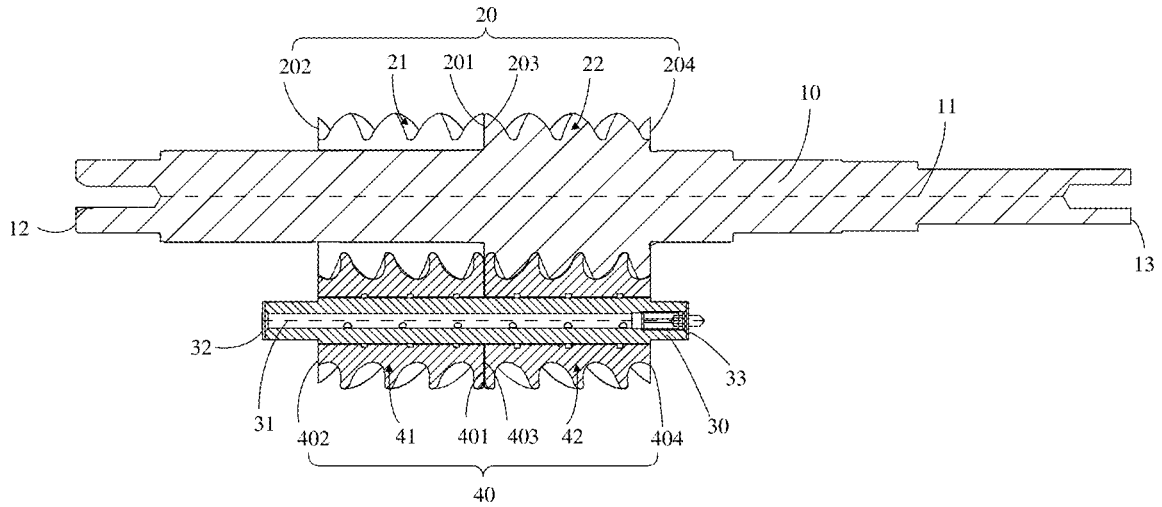
FIG. 2 is a schematic view showing a first rotor, a second rotor, a first shaft, and a second shaft cooperating with each other in the compressor provided by some embodiments of the present disclosure.

Referring to FIGS. 1 and 2, FIG. 1 is a schematic view of part of the structure of a compressor provided by some embodiments of the present disclosure; FIG. 2 is a schematic view showing a first rotor, a second rotor, a first shaft and a second shaft cooperating with each other in the compressor provided by some embodiments of the present disclosure.

Some embodiments of the present disclosure provide a compressor 100. The compressor 100 includes a first shaft 10, a first rotor 20, a second shaft 30, a second rotor 40, and a housing 50. The first shaft 10 and the second shaft 30 are disposed parallel to each other in the housing 50. The first rotor 20 is provided on the first shaft 10, and the second rotor 40 is provided on the second shaft 30. The first rotor 20 and the housing 50 have an axial gap, and the second rotor 40 and the housing 50 also have an axial gap.

Wherein the first rotor 20 and the second rotor 40 mesh with other. In some embodiments, the first rotor 20 is a male rotor and the second rotor 40 is a female rotor. The first rotor 20, as a male rotor, is understood as a driving rotor, and the second rotor 40, as a female rotor, is understood as a driven rotor. The first rotor 20 is in transmission connection with an electric motor 60, so that the first rotor 20 is driven by the electric motor 60 to rotate, and while rotating, the first rotor 20 drives the second rotor 40 meshing therewith to rotate synchronously.

In some embodiments, the first rotor 20 is carried by the first shaft 10, the first shaft 10 is configured to rotatably support the first rotor 20, and the first rotor 20 rotates about a first axis 11 of the first shaft 10. Under the action of the meshing of the first rotor 20 and the second rotor 40, the second rotor 40 is driven by the first rotor 20 to rotate on the second shaft 30 about a second axis 31 of the second shaft 30. The first rotor 20 includes a first portion 21 and a second portion 22 with opposite thread rotating direction. The first portion 21 is sleeved on the first shaft 10, the second portion 22 is integrally formed with the first shaft 10, and both the first portion 21 and the second portion 22 rotate about the first axis 11 within the housing 50. The first portion 21 and the second portion 22 with opposite thread rotating direction are separately machined and then assembled, with both the machining requirements and performance requirements of the first rotor 20 being considered.

It should be noted that, an end face of the first portion 21 close to the second portion 22 is a first suction end face 201, and an end face of the first portion 21 away from the second portion 22 is a first discharge end face 202. An end face of the second portion 22 close to the first portion 21 is a second suction end face 203, an end face of the second portion 22 away from the first portion 21 is a second discharge end face 204, and the first discharge end face 202 and the second discharge end face 204 have a gap.

With continued reference to FIGS. 1 and 2, the second rotor 40 is carried by the second shaft 30, and the second rotor 40 rotates about the second axis 31 within the housing 50. In some embodiments of the present disclosure, the second rotor 40 is sleeved on a circumferential outer side of the second shaft 30. In some embodiments, the second rotor 40 includes a third portion 41 and a fourth portion 42 with opposite thread rotating direction. The third portion 41 is configured to at least partially mesh with the first portion 21, and the fourth portion 42 is configured to at least partially mesh with the second portion 22. Wherein the third portion 41 and the first portion 21 have opposite thread rotating direction, and the fourth portion 42 and the second portion 22 have opposite thread rotating direction.

In some embodiments of the present disclosure, the first rotor 20 and the second rotor 40 are disposed in parallel in the housing 50. The first shaft 10 has a first end 12 and a second end 13, the first end 12 fixed on a bearing mounted within the housing 50 and the second end 13 is in driving connection with the electric motor 60, and the first portion 21 and the second portion 22 are located between the first end 12 and the second end 13. The second shaft 30 has a third end 32 and a fourth end 33 which are fixed to the housing 50 respectively. The second shaft 30 does not rotate relative to the housing 50 and is stationary with no relative movement. The third portion 41 and the fourth portion 42 are located between the third end 32 and the fourth end 33. The third portion 41 and the fourth portion 42 are both rotatable relative to the second shaft 30.

When the first rotor 20 and the second rotor 40 mesh and rotate, the first portion 21 generates a first axial force, and the second portion 22 generates a second axial force. Since the first portion 21 and the second portion 22 are disposed symmetrically and have opposite thread rotating direction, theoretically the first axial force and the second axial force are equal in magnitude and opposite in direction, so that the first axial force and the second axial force cancel each other out. Similarly, a third axial force and a fourth axial force also cancel each other out theoretically. In actual use, the compressor 100 may have a problem of unstable axial force at the moment of being turned on or off. Since the third portion 41 and the fourth portion 42 are rotatable relative to the second shaft 30, the positions of the third portion 41 and the fourth portion 42 may shift at the moment of turning on or off the compressor, so a problem of collision of the third portion 41 and/or the fourth portion 42 with the housing 50 may occur.

In view of this, the compressor 100 provided by some embodiments of the present disclosure further includes a first spacer 71, a first driving assembly 81 and a first distance sensor 91. The first driving assembly 81 is in driving connection with the first spacer 71, and drives the first spacer 71 to move along a direction of the first axis 11, so that a determined gap is always maintained between the first rotor 20 and the housing 50, and therefore, collision or abrasion of the first rotor 20 and the housing 50 can be avoided, thus improving the stability of the compressor 100.

Figure 3:
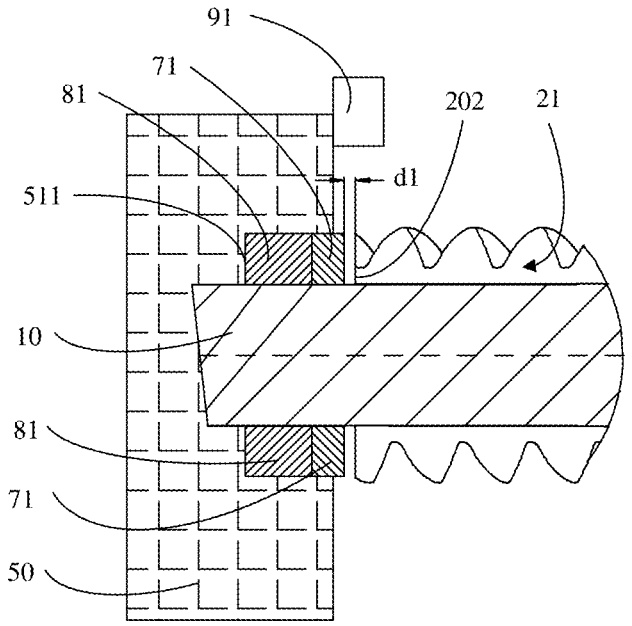
FIG. 3 is a view of the state of a first spacer and a first portion provided by some embodiments of the present disclosure.

Referring to FIG. 3 in combination with FIGS. 1 and 2, FIG. 3 is a view of the state of the first spacer and the first portion provided by some embodiments of the present disclosure. A side of the housing 50 facing the first portion 21 is provided with a first accommodating chamber 51. The first driving assembly 81 is disposed within the first accommodating chamber 51, a portion of the first spacer 71 is located within the first accommodating chamber 51, and another portion of the first spacer 71 protrudes from the first accommodating chamber 51. Wherein the first driving assembly 81 is in driving connection with the first spacer 71, and a distance d1 is reserved between the first spacer 71 and an end of the first portion 21. By the predetermined distance d1, the problem of the first rotor 20 colliding with the housing 50 will be avoided.

In some embodiments, the first driving assembly 81 includes a motor 811 and a transmission assembly 812. For example, the transmission assembly 812 is a gear assembly, and the transmission assembly 812 is in driving connection with the first spacer 71. Specifically, a miniature motor with a very small size is used as the motor. Under the driving of the miniature motor, the transmission assembly 812 drives the first spacer 71 to move along the direction of the first axis 11, to adjust the value of the distance d1 between the first spacer 71 and an end of the first portion 21, referring to FIG. 3.

In practical application, since the first rotor 20 operates for a long time, the first spacer 71 wears or deforms, which causes change in the distance d1 between the first spacer 71 and an end of the first portion 21, so the collision of the first rotor 20 with the first spacer 71 and the collision of the first rotor 20 with the housing 50 would be relatively serious, which will affect the performance and stability of the compressor 100. Thus, the compressor 100 provided by embodiments of the present disclosure further includes a first distance sensor 91 configured to detect the axial distance d1 between the first spacer 71 and an end of the first portion 21. The first driving assembly 81 is configured to control the first spacer 71 to move along the direction of the first axis 11 according to the axial distance between the first spacer 71 and an end of the first portion 21.

Figure 4:
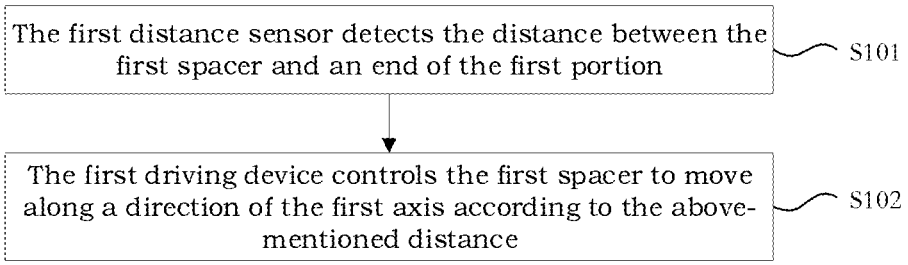
FIG. 4 is a flowchart of the control process of a first distance sensor and a first driving assembly provided by some embodiments of the present disclosure.

Referring to FIGS. 3 and 4, FIG. 4 is a flowchart of the control process of the first distance sensor 91 and the first driving assembly 81 provided by some embodiments of the present disclosure. The control process of the first distance sensor 91 and the first driving assembly 81 provided by some embodiments of the present disclosure includes:

S101, in which the first distance sensor 91 detects the distance between the first spacer 71 and an end of the first portion 21.

The distance between the first spacer 71 and an end of the first portion 21 is d1 as shown in FIG. 3.

S102, in which the first driving assembly 81 controls the first spacer 71 to move along the direction of the first axis 11 according to the above-mentioned distance.

In some embodiments, during operation of the compressor 100, when the first distance sensor 91 detects that the distance between the first spacer 71 and an end of the first portion 21 is greater than a predetermined distance threshold, the first driving assembly 81 controls the first spacer 71 to move towards the first portion 21 of the first rotor 20 along the direction of the first axis 11, to make the distance between the first spacer 71 and an end of the first portion 21 equal to the predetermined distance threshold, so as to reduce or even avoid the possibility of collision of the first rotor 20 and the housing 50, and improve the stability of the performance of the compressor 100.

In some embodiments, during operation of the compressor 100, when the first distance sensor 91 detects that the distance between the first spacer 71 and an end of the first portion 21 is less than or equal to the predetermined distance threshold, the first driving assembly 81 controls the first spacer 71 to move in a direction away from the first portion 21 along the direction of the first axis 11, to make the distance between the first spacer 71 and an end of the first portion 21 equal to the predetermined distance threshold, so as to avoid collision of the first rotor 20 and the housing 50 which affects the stability of the performance of the compressor 100.

Figure 5:
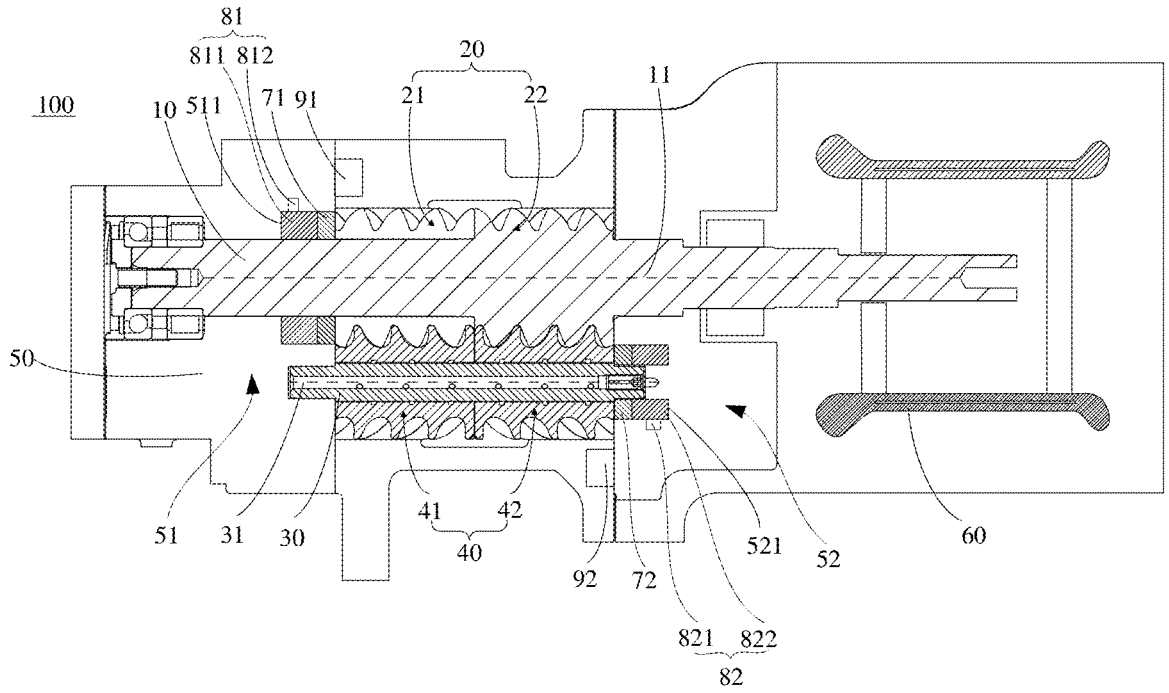
FIG. 5 is a schematic view of part of the structure of a compressor of a second type provided by some embodiments of the present disclosure.
Figure 6:
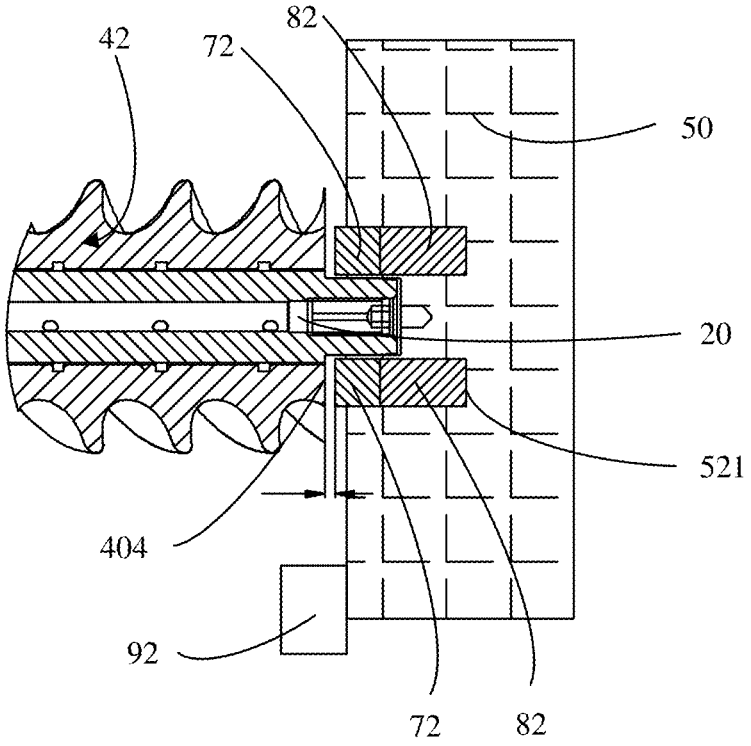
FIG. 6 is a view of the state of a second spacer and a second portion provided by some other embodiments of the present disclosure.

Referring to FIGS. 5 and 6, FIG. 5 is a schematic view of part of the structure of a compressor provided by some embodiments of the present disclosure; FIG. 6 is a view of the state of a second spacer and a second portion provided by some other embodiments of the present disclosure.

Referring to FIG. 5, in some other embodiments of the present disclosure, the compressor 100 further includes a second spacer 72, a second driving assembly 82 and a second distance sensor 92. Wherein the second driving assembly 82 is in driving connection with the second spacer 72, and controls the second spacer 72 to make it movable along a direction of the second axis 31, so that a determined gap is always maintained between the second rotor 40 and the housing 50, thus reducing or even avoiding the possibility of collision or abrasion of the second rotor 40 and the housing 50 and further improving the stability of the compressor 100.

A side of the housing 50 facing the fourth portion 42 is provided with a second accommodating chamber 52. The second driving assembly 82 is disposed within the second accommodating chamber 52, a portion of the second spacer 72 is located within the second accommodating chamber 52, and another portion of the second spacer 72 protrudes from the second accommodating chamber 52. Wherein the second driving assembly 82 is in driving connection with the second spacer 72, and a distance d2 is reserved between the second spacer 72 and an end of the fourth portion 42. By the predetermined distance d2, the problem of the second rotor 40 colliding with the housing 50 will be avoided.

In some embodiments, the second driving assembly 82 includes a motor and a transmission assembly. The transmission assembly is a gear assembly, and the transmission assembly is in driving connection with the second spacer 72. Specifically, a miniature motor with a small size is used as the motor. Under the driving of the miniature motor, the transmission assembly drives the second spacer 72 to move along the direction of the second axis 31, i.e., adjust the value of the distance d2 between the second spacer 72 and an end of the fourth portion 42, referring to FIG. 6.

In practical application, since the second rotor 40 operates for a long time, the second spacer 72 wears or deforms, which causes change in the distance d2 between the second spacer 72 and the fourth portion 42, so the collision of the second rotor 40 with the second spacer 72 and the collision of the second rotor 40 with the housing 50 would be relatively serious, which will affect the performance and stability of the compressor 100. Thus, the compressor 100 provided by some embodiments of the present disclosure further includes a second distance sensor 92 configured to detect the distance between the second spacer 72 and an end of the fourth portion 42. The second driving assembly 82 is configured to control the second spacer 72 to move along the direction of the second axis 31 according to the distance between the second spacer 72 and an end of the fourth portion 42.

Figure 7:
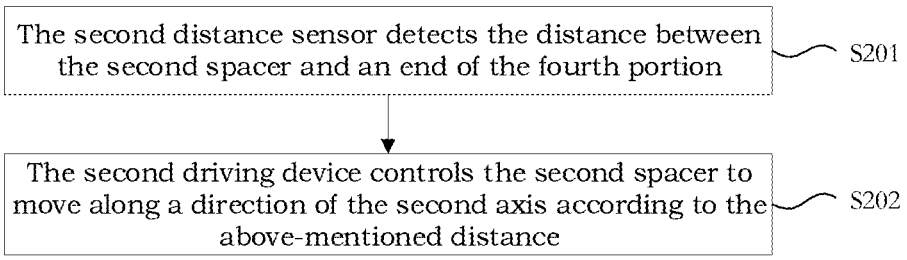
FIG. 7 is a flowchart of the control process of a second distance sensor and a second driving assembly provided by some other embodiments of the present disclosure.

Referring to FIGS. 6 and 7, FIG. 7 is a flowchart of a control process of the second distance sensor 92 and the second driving assembly 82 provided by some other embodiments of the present disclosure. The control process of the second distance sensor 92 and the second driving assembly 82 provided by embodiments of the present disclosure includes:

S201, in which the second distance sensor 92 detects the distance between the first spacer 72 and an end of the fourth portion 42.

The distance between the second spacer 72 and an end of the fourth portion 42 is d2 as shown in FIG. 6.

S202, in which the second driving assembly 82 controls the second spacer 72 to move along the direction of the second axis 31 according to the above-mentioned distance.

In some embodiments, during operation of the compressor 100, when the second distance sensor 91 detects that the distance between the second spacer 72 and an end of the fourth portion 42 is greater than a predetermined distance threshold, the second driving assembly 82 controls the second spacer 72 to move towards the fourth portion 42 of the second rotor 40 along the direction of the second axis 31, to make the distance between the second spacer 72 and an end of the fourth portion 42 consistent with the predetermined distance threshold, so as to reduce collision of the second rotor 40 and the housing 50 which affects the stability of the performance of the compressor 100.

In some embodiments, during operation of the compressor 100, when the second distance sensor 91 detects that the distance between the second spacer 72 and an end of the fourth portion 42 is less than or equal to the predetermined distance threshold, the second driving assembly 82 controls the second spacer 72 to move towards the housing 50 along the direction of the second axis 31, to make the distance between the second spacer 72 and an end of the fourth portion 42 consistent with the predetermined distance threshold, such that the second rotor 40 and the housing 50 are less likely to collide, to improve the stability of the performance of the compressor 100.

For the above-mentioned embodiments, it should be noted that, the material of the first spacer 71 and the second spacer 72 may be a material with soft texture, such as PEEK material. The hardness of the material of both the first spacer 71 and the second spacer 72 is lower than that of the housing 50 and that of the first rotor 20 and the second rotor 40. The shapes of the first spacer 71 and the second spacer 72 are also not particularly limited in the embodiments of the present disclosure.

By providing the first spacer 71 between the first rotor 20 and the housing 50, connecting the first driving assembly 81 with the first spacer 71 and controlling the first spacer 71 to move along the direction of the first axis 11, the compressor 100 provided by some embodiments of the present disclosure always maintains a gap between the first rotor 20 and the housing 50, so that collision or abrasion of the first rotor 20 and the housing 50 are less likely to occur, which improves the stability of the compressor 100.

It should be noted that the second portion 22 and the housing 50 is provided with a spacer or provided with no spacer therebetween. Similarly, the third portion 41 and the housing 50 is provided with a spacer or provided with no spacer therebetween.

The embodiments of the present disclosure further provide an air conditioner including the above-mentioned compressor 100, and it also has the technical effects described above.

In description of the present disclosure, it needs to be appreciated that orientation or position relations denoted by the terms "center", "longitudinal", "transverse", "front", "rear", "left", "right", "vertical", "horizontal", "top", "bottom", "inner", "outer" and the like are orientation or position relations illustrated based on the drawings, are merely for the convenience of describing the present disclosure and simplifying description, instead of indicating or implying the denoted assemblies or elements must have specific orientations or be constructed and operated in specific orientations, and thus the terms cannot be construed as limiting the protection scope of the present disclosure.

Finally, it should be noted that the above embodiments are only used for describing rather than limiting the technical solutions of the present disclosure. Although the present disclosure is described in detail with reference to the preferred embodiments, those of ordinary skill in the art should understand that they still can make modifications to the specific implementations in the present disclosure or make equivalent substitutions to part of technical features thereof; and such modifications and equivalent substitutions should be encompassed within the scope of the technical solutions sought for protection in the present disclosure so long as they do not depart from the spirit of the technical solutions of the present disclosure.

The invention claimed is:

1. A compressor, comprising:

a housing;

a first rotor disposed spaced apart from the housing, the first rotor being capable of rotating along a first axis, the first rotor comprising a first portion and a second portion with opposite thread rotating direction;

a first spacer, at least a portion of the first spacer being disposed between the first portion and the housing; and a first driving assembly in driving connection with the first spacer to control the first spacer to move along a direction of the first axis;

wherein the first driving assembly comprises:

a first motor; and a first transmission assembly in driving connection with the first spacer, the first transmission assembly driving the first spacer to move along the direction of the first axis under the driving of the first motor.

2. The compressor according to claim 1, further comprising:

a first shaft, the first portion being sleeved on the first shaft, the second portion being integrally formed with the first shaft.

3. The compressor according to claim 2, wherein a side of the housing facing the first portion is provided with a first accommodating chamber, the first driving assembly is disposed within the first accommodating chamber, a portion of the first spacer is located within the first accommodating chamber, and another portion of the first spacer is located between the first portion and the housing.

4. The compressor according to claim 1, further comprising:

a first distance sensor configured to detect a distance between the first spacer and an end of the first portion.

5. The compressor according to claim 4, wherein the first driving assembly is configured to control the first spacer to move along the direction of the first axis according to the distance between the first spacer and an end of the first portion.

6. The compressor according to claim 5, wherein when controlling the first spacer to move along the direction of the first axis according to the distance between the first spacer and an end of the first portion, the first driving assembly is configured such that:

when the distance between the first spacer and an end of the first portion is greater than a predetermined distance threshold, the first driving assembly controls the first spacer to move along the direction of the first axis towards the first portion of the first rotor;

when the distance between the first spacer and an end of the first portion is less than or equal to the predetermined distance threshold, the first driving assembly controls the first spacer to move along the direction of the first axis towards the housing.

7. The compressor according to claim 1, further comprising:

a second rotor disposed spaced apart from the housing, the second rotor being configured to rotate about a second axis, the second rotor comprising a third portion and a fourth portion with opposite thread rotating direction, the third portion being configured to at least partially mesh with the first portion, and the fourth portion being configured to at least partially mesh with the second portion; and a second shaft, the third portion and the fourth portion being sleeved on the second shaft.

8. The compressor according to claim 7, further comprising:

a second spacer, at least a portion of the second spacer being disposed between the fourth portion and the housing; and a second driving assembly in driving connection with the second spacer to control the second spacer to move along a direction of the second axis;

the second driving assembly comprises a second motor and a second transmission assembly, the second transmission assembly is a second gear assembly, and the second transmission assembly is in driving connection with the second spacer.

9. The compressor according to claim 8, wherein a side of the housing facing the fourth portion is provided with a second accommodating chamber, the second driving assembly is disposed within the second accommodating chamber, a portion of the second spacer is located within the second accommodating chamber, and another portion of the second spacer is located between the fourth portion and the housing.

10. The compressor according to claim 8, further comprising:

a second distance sensor configured to detect a distance between the second spacer and an end of the fourth portion.

11. The compressor according to claim 10, wherein the second driving assembly is configured to control the second spacer to move along the direction of the second axis according to the distance between the second spacer and an end of the fourth portion.

12. The compressor according to claim 10, wherein when controlling the second spacer to move along the direction of the second axis according to the distance between the second spacer and an end of the fourth portion, the second driving assembly is configured to:

control the second spacer to move along the direction of the second axis towards the fourth portion of the second rotor when the distance between the second spacer and an end of the fourth portion is greater than a predetermined distance threshold;

control the second spacer to move along the direction of the second axis towards the housing when the distance between the second spacer and an end of the fourth portion is less than or equal to the predetermined distance threshold.

13. An air conditioner comprising the compressor according to claim 1.

* * * * *